US007637400B2

(12) United States Patent
Py et al.

(10) Patent No.: US 7,637,400 B2
(45) Date of Patent: Dec. 29, 2009

(54) CONTAINER AND VALVE ASSEMBLY FOR STORING AND DISPENSING SUBSTANCES, AND RELATED METHOD

(75) Inventors: Daniel Py, Larchmont, NY (US); Julian V. Chan, Spring Valley, NY (US)

(73) Assignee: Medical Instill Technologies, Inc., New Milford, CT (US)

( * ) Notice: Subject to any disclaimer, the term of this patent is extended or adjusted under 35 U.S.C. 154(b) by 649 days.

(21) Appl. No.: 11/301,659

(22) Filed: Dec. 12, 2005

(65) Prior Publication Data

US 2006/0131340 A1 Jun. 22, 2006

Related U.S. Application Data

(60) Provisional application No. 60/634,958, filed on Dec. 10, 2004.

(51) Int. Cl.
*B65D 5/72* (2006.01)

(52) U.S. Cl. ..... 222/492; 220/714

(58) Field of Classification Search ..... 222/491–497, 222/107, 212, 213, 422, 96, 566, 571; 215/11.1, 215/11.4, 387; 220/703, 711, 714, 717
See application file for complete search history.

(56) References Cited

U.S. PATENT DOCUMENTS

| | | | | |
|---|---|---|---|---|
| 2,128,035 | A | 8/1938 | Boetel | 221/60 |
| 3,412,910 | A | 11/1968 | Hahn | 222/494 |
| 3,648,903 | A | 3/1972 | Marchant | 222/212 |
| 3,669,323 | A | 6/1972 | Harker et al. | 222/490 |
| 3,963,814 | A | 6/1976 | Cospen et al. | 264/23 |
| 4,002,516 | A | 1/1977 | Gaborieau et al. | 156/69 |
| 4,102,476 | A | 7/1978 | Loeffler | 222/209 |
| 4,141,474 | A | 2/1979 | Nilson | 222/493 |
| 4,513,891 | A | 4/1985 | Hain et al. | 222/213 |
| 4,699,300 | A | 10/1987 | Blake | 222/494 |
| 4,737,148 | A | 4/1988 | Blake | 604/126 |
| 4,739,906 | A | 4/1988 | LoTurco | 222/153 |
| 4,842,165 | A | 6/1989 | Van Coney | 222/95 |
| 4,895,279 | A | 1/1990 | Schultz | 222/321 |
| 4,923,480 | A | 5/1990 | Monestere | 8/507 |
| 4,949,877 | A | 8/1990 | Hanna et al. | 222/341 |

(Continued)

FOREIGN PATENT DOCUMENTS

| | | |
|---|---|---|
| EP | 0649795 B1 | 6/1999 |

(Continued)

*Primary Examiner*—Lien T Ngo
(74) *Attorney, Agent, or Firm*—McCarter & English, LLP

(57) ABSTRACT

A container and valve assembly for storing and dispensing substances including edible substances. The container is a tubular body that defines a storage chamber for storing the substance and a head portion for supports the valve assembly. The valve assembly includes a valve body and a valve seat surrounded by a flexible outer cover that includes a valve portion. A seem between the valve portion and valve seat form a one-way release valve wherein a portion of the seam remains closed when the substance is dispensed. To dispense the substance, pressure is applied to the body forcing the substance into the valve assembly, which in turn, controls the flow and release of the substance without exposing the remaining substance to the external atmosphere; thus, the sterility of the storage chamber and remaining substance is maintained, and the shelf life of the substance is increased.

20 Claims, 4 Drawing Sheets

U.S. PATENT DOCUMENTS

| | | | | |
|---|---|---|---|---|
| 4,978,036 | A | 12/1990 | Burd | 222/207 |
| 5,033,647 | A | 7/1991 | Smith et al. | 222/94 |
| 5,083,416 | A | 1/1992 | Schneider et al. | 53/489 |
| 5,108,007 | A | 4/1992 | Smith et al. | 222/95 |
| 5,178,300 | A | 1/1993 | Haviv et al. | 222/95 |
| 5,197,638 | A | 3/1993 | Wood | 222/212 |
| 5,226,568 | A | 7/1993 | Newton et al. | 222/212 |
| 5,318,204 | A | 6/1994 | Davis et al. | 222/95 |
| 5,320,256 | A | 6/1994 | Wood | 222/212 |
| 5,320,845 | A | 6/1994 | Py | 424/427 |
| 5,332,121 | A | 7/1994 | Schmidt et al. | 222/95 |
| 5,339,972 | A | 8/1994 | Crosnier et al. | 215/320 |
| 5,416,303 | A | 5/1995 | Grooms et al. | 219/633 |
| 5,489,026 | A | 2/1996 | D'Aloia | 206/570 |
| 5,489,027 | A | 2/1996 | Goerigk | 206/570 |
| 5,497,910 | A | 3/1996 | Meadows et al. | 222/95 |
| 5,556,678 | A | 9/1996 | Jupin et al. | 428/36.6 |
| 5,564,596 | A | 10/1996 | Meadows et al. | 222/94 |
| 5,582,330 | A | 12/1996 | Iba | 222/212 |
| 5,609,273 | A | 3/1997 | Firestone et al. | 222/215 |
| 5,664,704 | A | 9/1997 | Meadows et al. | 222/209 |
| 5,692,651 | A | 12/1997 | Fuchs | 222/494 |
| 5,718,334 | A | 2/1998 | Demel | 206/438 |
| 5,727,892 | A | 3/1998 | Baudin | 401/263 |
| 5,730,322 | A | 3/1998 | Iba et al. | 222/42 |
| 5,743,441 | A | 4/1998 | Baudin et al. | 222/212 |
| 5,746,728 | A | 5/1998 | Py | 604/298 |
| 5,759,218 | A | 6/1998 | Martin et al. | 55/385.1 |
| 5,799,837 | A | 9/1998 | Firestone et al. | 222/215 |
| 5,823,397 | A | 10/1998 | Gil | 222/181.3 |
| 5,855,302 | A | 1/1999 | Fisscher | 222/207 |
| 5,899,624 | A | 5/1999 | Thompson | 401/206 |
| 5,921,989 | A | 7/1999 | Deacon et al. | 606/107 |
| 5,934,500 | A | 8/1999 | Cogger et al. | 220/495.06 |
| 5,944,702 | A | 8/1999 | Py | 604/298 |
| 6,032,101 | A | 2/2000 | Freedman et al. | 702/8 |
| 6,050,444 | A | 4/2000 | Sugg | 220/707 |
| 6,053,370 | A | 4/2000 | Ludbrook et al. | 222/207 |
| 6,062,437 | A | 5/2000 | Mascitelli | 222/212 |
| 6,083,450 | A | 7/2000 | Safian | 264/515 |
| 6,145,707 | A | 11/2000 | Baudin | 222/189.09 |
| 6,170,705 | B1 | 1/2001 | Schneider et al. | 222/92 |
| RE37,047 | E | 2/2001 | Py | 604/294 |
| 6,202,901 | B1 | 3/2001 | Gerber et al. | 222/494 |
| 6,254,579 | B1 | 7/2001 | Cogger et al. | 604/298 |
| 6,267,768 | B1 | 7/2001 | Deacon et al. | 606/107 |
| 6,283,976 | B1 | 9/2001 | Portney | 606/107 |
| 6,301,767 | B1 | 10/2001 | Granger et al. | 29/469.5 |
| 6,306,423 | B1 | 10/2001 | Donovan et al. | 424/423 |
| 6,312,708 | B1 | 11/2001 | Donovan | 424/423 |
| 6,325,253 | B1 | 12/2001 | Robinson | 222/212 |
| 6,351,924 | B1 | 3/2002 | Gustafsson et al. | 53/425 |
| 6,383,509 | B1 | 5/2002 | Donovan et al. | 424/423 |
| 6,386,395 | B1 | 5/2002 | Lunghetti | 222/213 |
| 6,428,545 | B2 | 8/2002 | Portney | 606/107 |
| 6,446,844 | B1 | 9/2002 | Gross | 222/494 |
| 6,450,994 | B1 | 9/2002 | Boyles et al. | 604/294 |
| 6,662,977 | B2 | 12/2003 | Gerber et al. | 222/494 |
| 6,761,286 | B2 | 7/2004 | Py et al. | 222/105 |
| 6,892,906 | B2 * | 5/2005 | Py et al. | 222/494 |
| 2002/0017294 | A1 | 2/2002 | Py | 128/200 |
| 2002/0074362 | A1 | 6/2002 | Py et al. | 222/388 |
| 2004/0112925 | A1 | 6/2004 | Py et al. | 222/494 |

FOREIGN PATENT DOCUMENTS

| | | |
|---|---|---|
| EP | 0673852 B1 | 2/2000 |

* cited by examiner

CONTAINER AND VALVE ASSEMBLY FOR STORING AND DISPENSING SUBSTANCES, AND RELATED METHOD

CROSS-REFERENCE TO RELATED APPLICATIONS

This application claims priority to U.S. Provisional Patent Application No. 60/634,958, filed Dec. 10, 2004, which is hereby expressly incorporated by reference as part of the present disclosure.

BACKGROUND OF THE INVENTION

1. Field of the Invention

The present invention relates to containers for dispensing substances including edible substances, and more particularly, to improved containers including one-way valves and collapsible and/or squeeze tubes that maintain the product in an airless and/or sterile condition during repeated dispensing.

2. Background of the Related Art

Flexible tubes and the like are used to store a variety of substances including edible foods and beverages having a broad range of viscosities. Generally, the flexible tubes have a cover which is removed to expose a simple release aperture through which the stored substance is dispensed. As a result, low pressures are required to dispense the substance thereby causing unwanted oozing and build-up, which ultimately leads to inhibited flow and clogging at the release aperture. Moreover, when the traditional tube is opened during operation, the contents are continually exposed to the ambient environment, thus exposing the contents to bacteria, germs and/or other impurities during and/or after the product is dispensed. Furthermore, unwanted air is often drawn into the tube which facilitates the spreading of the bacteria, germs and/or other impurities with each subsequent use, and also negatively impacts the flow characteristics of the substance during dispensing, such that the substance is dispensed unevenly, contains air bubbles or continues to ooze out unwantedly. Despite techniques for sterilizing the stored contents prior to opening, this constant exposure to the environment has the negative effect of degrading the stored substance, thereby limiting the shelf-life and range of products suitable for dispensing via tubes. As a result, such products must include preservatives in order to prevent the product remaining in the container from spoiling or otherwise degrading between usages. One of the drawbacks associated with preservatives is that they can cause an allergic or an otherwise undesirable reaction or effect on the user and/or product. In addition, the preservatives do not prevent the bulk product stored within the open container from collecting, and in some cases, facilitating the spread of contamination.

In view of the above, several containers have been provided with closure devices such as one-way valves. One drawback associated with prior art dispensers including one-way valves is that the valves are frequently designed to work with mechanical pumps or like actuators that are capable of creating relatively high valve opening pressures. Exemplary dispensers of this type are illustrated in U.S. Pat. Nos. RE 37,047, 6,032,101, 5,944,702, and 5,746,728 and U.S. Publication Nos. US2002/0074362 A1, US2002/0017294 A1. Squeeze tube-type dispensers, on the other hand, are not capable of creating the necessary valve opening pressures, and therefore such prior art valves do not work effectively with squeeze tubes.

Accordingly, it is an object of the present invention to overcome one or more of the above-described drawbacks and/or disadvantages of the prior art.

SUMMARY OF THE INVENTION

The invention is directed towards an apparatus having a container and a valve assembly for storing and dispensing a substance therefrom. The container includes a squeezable body defining therein a storage chamber for receiving and storing the substance, which can be edible, and a head located at one end of the body. The head defines a neck portion and a first axially extending passageway formed therethrough that is coupled in fluid communication with the storage chamber of the body and defines an unobstructed axially extending flow path therebetween.

The valve assembly is a one-way valve assembly mounted on the head that includes a valve body and a valve cover. The valve body includes a body base defining a second axially extending passageway coupled in fluid communication with the first axially extending passageway and defining an unobstructed axially extending flow path therebetween, an axially extending valve seat defining a diameter less than a diameter of the body base, and a plurality of flow apertures axially extending through the valve body adjacent to the valve seat and angularly spaced relative to each other. The valve cover is formed of an elastic material defining a predetermined modulus of elasticity and includes an outer valve cover shaped to receive a user's mouth, and a valve shield mounted between the valve cover and the outer valve cover. The valve shield supports the outer valve cover when a user applies pressure to the outer cover and is fixedly secured to the valve cover and the outer valve cover to prevent axial movement relative thereto. A valve portion overlies the valve seat and defines a predetermined radial thickness and a diameter less than a diameter of the valve seat to thereby form an interference fit therebetween. The valve portion and valve seat define a normally closed, annular, axially extending valve opening therebetween, and the valve portion is movable radially between a normally closed position with the valve portion engaging the valve seat and an open position with a segment of the valve portion spaced radially away from the valve seat to allow the passage of substance at a predetermined valve opening pressure therebetween. The valve shield is spaced radially away from the valve portion so as not to interfere with the valve opening.

In addition, at least one of the valve seat diameter, a degree of interference between the valve cover and valve seat, the predetermined radial thickness of the valve portion, and a predetermined modulus of elasticity of the valve cover material, is selected to (1) define a predetermined valve opening pressure generated upon manually squeezing the container that allows passage of the substance from the storage chamber through the valve opening, and (2) hermetically seal the valve and prevent the ingress of bacteria through the valve and into the container in the normally closed position.

These and other features, aspects, and advantages of the present invention will become better understood with regard to the following description, appended claims and accompanying drawings.

DETAILED DESCRIPTION

Figure 1:
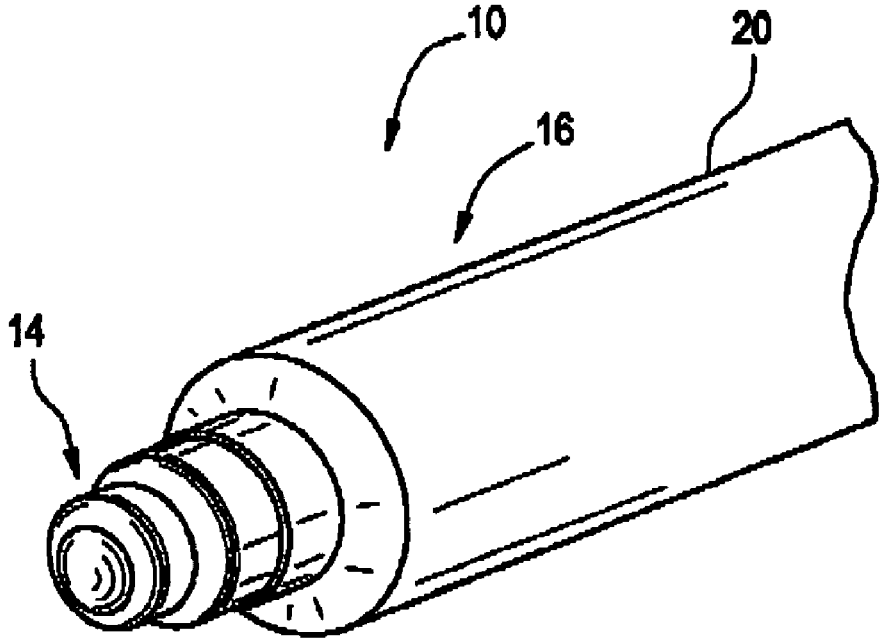
FIG. 1 is a perspective view of the apparatus of the present invention including a one-way valve and container.
Figure 2:
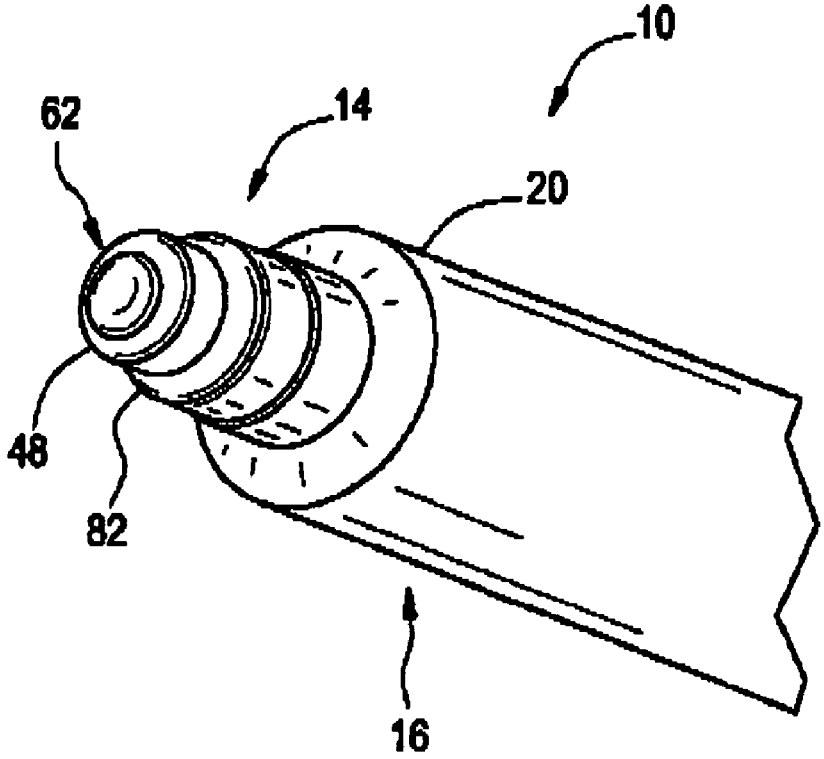
FIG. 2 is a partial, perspective view of the apparatus of FIG. 1.
Figure 3:
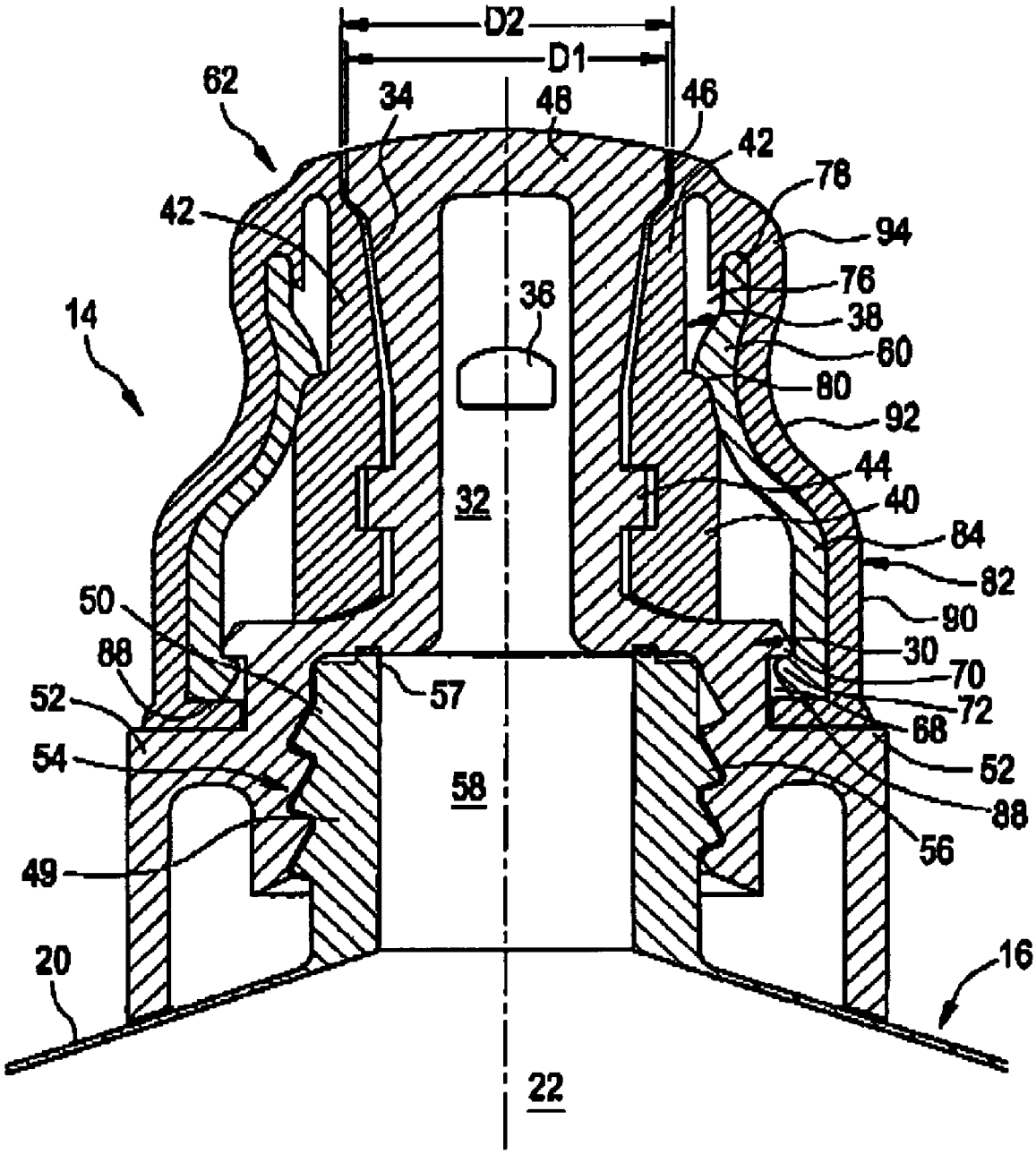
FIG. 3 is a cross-sectional view of the one-way valve of the apparatus of FIG. 1.

Referring to FIGS. 1-3, an apparatus including a one-way valve assembly and container embodying the present invention is indicated generally by the reference numeral 10. While the exemplary embodiments illustrate a tubular container, it is understood that any shaped container is contemplated, including a cylindrical or bottle shape. The apparatus 10 includes a one-way valve assembly 14 that is connectable in fluid communication with a container 16. A cap (not shown) may be releasably connected to the valve assembly 14 for covering the valve assembly when not in use.

The container 16 comprises a body 20 defining therein a storage chamber 22 (FIG. 3) for receiving and storing a substance and a head 49 at one end of the body 20. The substance includes products that are creamy, pasty, liquid, or other such substance. In one embodiment, it is contemplated that the type of substances that are included are substances that could be ingested, such as cheese, yogurt, milk, nutritional beverages, shakes, and baby food. As may be recognized by those of ordinary skill in the pertinent art based on the teachings herein, this list is intended to be exemplary and in no way limiting.

The container includes any type of container that can hold the substance. The container 16 and body 20 can be made from any material that does not substantially alter the contents therein, unless otherwise specified to do so. In one embodiment, the body 20 may be all plastic, aluminum, a combination thereof, and/or a plurality of other suitable materials well known to those skilled in the art now and later discovered. In another embodiment, the body 20 is made from a coextruded sheet containing various combinations of LDPE, LLDPE, HDPE, tie resins and foil. The body 20 can be customized for the application, for example, by color, shape, decoration, coatings and the like. Additionally, the container 16 can be sized to be portable or otherwise as may be desired and can include outer textures for improved comfort, gripping and handling. The body 20 also provides a barrier to oxygen, moisture, flavor loss and the like.

In the above embodiments, the body 20 may be squeezed in a conventional manner, such as squeezing the body on opposites sides relative to each other and, in turn, transmitting a substantially radially-directed force into the body. By squeezing the body, the pressure of the product or other substance contained within the body is increased until the pressure is great enough to push the product out the valve assembly 14.

In yet another embodiment, the container 16 may include a more rigid body and a flexible bladder located in the container that holds the substance, such as that disclosed in U.S. Pat. No. 6,761,286, which is hereby expressly incorporated by reference as part of the present disclosure.

The valve assembly 14 releases the substance without exposing the remaining product to the external atmosphere; thus, the sterility and/or airless condition of the storage chamber 22 is maintained and the shelf life of the product is not decreased. Further, bacteria or other contaminants are prevented from passing through the valve and into the storage chamber even when the apparatus is being used, as described further below. Accordingly, even after the apparatus 10 is being used, refrigeration is not necessary to sustain the life of the substance inside the container 16.

Drawing attention to FIG. 3, valve assembly 14 is shown in greater detail. Accordingly, valve assembly 14 includes a valve body 30 defining a first axially-extending passageway 32, an axially-extending valve seat 34, and at least one or a plurality of flow apertures 36 axially extending through the valve body 30 adjacent to the valve seat 34 and coupled in fluid communication with the first axially-extending passageway 32. The valve body 30 may be made of various materials and, in one embodiment, is made of polypropylene. The one-way valve assembly 12 further includes a valve cover 38 formed of an elastic material and including a cover base 40 mounted on the valve body 30 and fixedly secured against axial movement relative thereto, and a valve portion 42 overlying the valve seat. In the embodiment shown, the valve body 30 and the cover base 40 are fixedly secured by an annular protuberance 44 formed at the valve body 30, which prevents axial movement of the cover base 40 with respect to the valve body 30.

The valve portion 42 defines a predetermined radial thickness and a progressively increasing inner diameter D1. The valve seat 34 defines a progressively increasing outer diameter D2. The valve is designed so that the inner diameter D1 is less than the outer diameter D2 to form an interference fit therebetween, as indicated by the overlapping lines in FIG. 3. As can be seen, the valve portion 42 and the valve seat 34 define a normally closed, axially-extending valve opening or seam 46 therebetween. As described further below, the valve portion 42 is movable radially between a normally closed position, as shown in FIG. 3, with the valve portion 42 engaging the valve seat 34, and an open position (not shown) with at least a segment of the valve portion 42 spaced radially away from the valve seat 34 to connect the valve opening 46 in fluid communication with the flow apertures 36 to thereby allow the passage of substance from the flow apertures 36 through the valve opening 46.

The valve portion 42 of the valve cover 38 has a progressively decreasing radial thickness when moving axially in a direction from the protuberance 44 toward an exit 48. In addition, as indicated above, the valve seat 34 defines a progressively increasing diameter D2 when moving axially in a direction from an inner end toward a distal end of the valve seat (or from the interior end toward the exterior end of the valve seat). As a result, progressively less energy is required to open the valve when moving axially in the direction from the interior toward the exterior of the valve. Stored substance is dispensed through the valve by pumping the substance at a sufficient pressure (either by manually, mechanically or electro-mechanically squeezing the tube 14, or otherwise pumping the substance through the tube or into the valve) through the flow apertures 36 to open the valve opening or seam 46 (the "valve opening pressure"). Once the pressurized substance enters the valve opening or seam 46, progressively less energy is required to radially open respective axial segments of the valve cover when moving axially in the direction from the interior toward the exterior of the valve. As a result, the valve itself operates as a pump to force the substance through the normally-closed valve opening 46. In one embodiment, a substantially annular segment of the valve portion 42 engages the valve seat 34 substantially throughout any period of dispensing substance through the valve opening 46 to maintain a hermetic seal between the valve opening 46 and ambient atmosphere. If desired, the valve can be configured in other ways in order to require progressively less energy to open the valve (i.e., to decrease the valve opening pressure) when moving in the axial direction from the interior toward the exterior of the valve. For example, the valve cover 38 and valve body 30 may define a decreasing degree of interference therebetween when moving in a direction from the interior toward the exterior of the valve assembly. Alternatively, the valve cover may define a substantially conically tapered cross-sectional shape. If desired, the valve assembly may include only one of these features, or may include any desired combination of these features in order to achieve the desired performance characteristics.

In particular, at any point along the normally closed valve opening or seam 46, at least one of the valve seat diameter D2, the degree of interference between the valve portion 42 and valve seat 34 (as indicated by the overlapping lines in FIG. 3), the predetermined radial thickness of the valve portion 42, and a predetermined modulus of elasticity of the valve cover 38 material, is selected to (1) define a predetermined valve opening pressure generated upon squeezing the container 16 that allows passage of the substance from the tube through the normally-closed valve opening 46, and (2) hermetically seal the valve assembly 14 and prevent the ingress of bacteria or contamination through the valve opening 46 and into the container 16 in the normally closed position. In the illustrated embodiment of the present invention, each of the valve seat diameter D2, the degree of interference between the valve portion 42 and valve seat 34, the predetermined radial thickness of the valve portion 42, and the predetermined modulus of elasticity of the valve cover 38 material, is selected to (i) define a predetermined valve opening pressure generated upon squeezing the tube 14 that allows passage of the substance from the tube (or variable-volume storage chamber 22 coupled in fluid communication thereto) through the valve opening 46, and (2) hermetically seal the valve opening 46 and prevent the ingress of bacteria through the valve opening and into the tube in the normally-closed position.

The valve body 30 is secured to the head 49 of the body 20 via a neck portion 50. The valve body 30 further includes a body base 52 that has a connecting portion 54, which is configured to connect the valve assembly 14 to the container 16. In the embodiment shown, the valve assembly 14 and the container 16 are configured to be threadably connected at the neck 50, as is illustrated by the threads 56. However, it is understood that valve assembly 14 and the container 16 may be connected in any known manner. The neck 50 forms an interference fit at a top 57 of neck 50 to hermetically seal the container 16 and the valve assembly 14. In addition, the neck 50 defines a second axially extending passageway 58, which is in fluid communication with the first axially extending passageway 32.

The valve assembly 14 further includes a valve shield 60 that extends annularly about the flexible valve cover 38, and extends axially from the base of the valve cover 38 to a point adjacent to a dispensing tip 62 of the valve assembly 14 but spaced axially inwardly therefrom. The valve shield 60 is made of a rigid material so that the valve shield 60 will not deform when pressure is applied to it. The valve body 30 defines an annular recess 68 between a peripheral flange 70 and body base 52. The valve shield 60 defines a first corresponding annular protuberance 72 that projects radially inwardly and is snap fit into the recess 68 and engages the flange 70 to lock the valve shield 60 to the valve body 30.

The valve shield 60 is spaced radially relative to the valve portion 42 of the valve cover 38 to form an annular, axially extending gap 76 therebetween. The gap 76 allows the valve portion 42 to freely expand or move radially outwardly during dispensing of substance through the normally closed valve opening or seam 46. The gap 76 decreases away from a tip 78 of valve shield 60 to an area 80 in which the valve shield 60 contacts to the valve cover 38. The area 80 of contact helps protect and support the valve cover 38. Additionally, area 80 is aligned with aperture 36 to prevent radial movement of the valve cover 38 and prevent forward flow of any substance that has not entered the valve.

The valve cover 38 extends over valve shield 60 to form an outer valve cover 82 and is secured to body base 52 so that valve shield 60 is enclosed within valve cover 38. On an exterior side 84 of valve shield 60, valve cover 38 contacts valve shield 60 so as to support the outer valve cover 82. In one embodiment, an optional annular protuberance 86 located on an end of the valve shield engages an optional recess 88 in the outer valve cover 82 to further secure the outer valve 82 and shield 60 to the head 49 of the container 16. The gap 76 extends above the tip 78 of the valve shield 60, which allows valve portion 42 to expand outwardly when the valve opening 46 is in the open position. In addition, outer valve cover 82 is shaped so that the tip 78 of the valve shield 60 is fully supported by the outer valve cover 82 so that the tip 78 of the valve shield 60 does not bend and contact the valve portion 42.

The outer valve cover 82 is shaped to accept a mouth, and in one embodiment, a child's mouth. The outer valve cover 82 includes a neck 90, a concave contour section 92, and a rounded tip 94. The concave contour section 92 would receive the user's lips. In addition, the valve shield 60 is shaped similar to the outer valve cover 82 so that the outer valve cover 82 is fully supported along the entire outer cover and also to protect the valve opening 46. For instance, when the valve assembly 14 is received into a mouth, even if the person was to clamp down on the outer valve cover 82, the valve opening 46 will not be affected since any pressure on the valve cover 38 would occur at the area 80, which is outside of the valve opening 46 area. Thus, even when pressure is applied on the outer valve cover 82, valve opening 46 will be able to expand and dispense the substance from the storage chamber 22.

While the valve cover 38 and the outer valve cover 82 are shown as an integral piece, it is understood that the two parts are not required to be integral in order for the valve assembly 14 to function properly. The valve cover 38 and outer valve cover 82 are made of a material that is capable of deformation, such as santoprene (shore 35) or rimflex (shore 25). Thus, the covers 38 and 82 are soft and flexible.

In addition, it maybe desirable to make the outer diameter of the valve seat 34 as large as possible to thereby decrease the requisite valve opening pressure that must be generated upon squeezing the body 20 in order to open the valve and dispense product through the valve. There are a variety of factors that can affect the valve opening pressure, including the diameter of the valve seat 34, the modulus of elasticity of the valve cover 38, the degree of interference between the valve cover 38 and valve seat 34, and the thickness and shape of the valve seat 34. All other factors being equal, the volumetric flow rate of material through the valve will be greater for increasing diameters of the valve seat 34 and the requisite valve opening pressure will decrease. It may be desirable to (1) increase the diameter of the valve seat 34 in comparison to prior art valves in order to decrease the requisite valve opening pressure that must be created upon squeezing the tube; (2) decrease the head loss of the product flowing through the valve in comparison to prior art valves; and (3) decrease the stored elastic energy in the valve upon dispensing the product through the valve in order to, in turn, decrease the residual seepage of product through the valve. As such, the path of the valve opening 46 increases in diameter as the valve opening approaches exit 48.

The apparatus 10 operates as follows. A user puts the valve assembly in the user's mouth so that the user's lips sit at the concave contour section 92. The user squeezes the container 16 so that the substance contained in the storage chamber 22 flows from the storage chamber through the passageways 58 and 32. From the passageways 58 and 32, the substance flows into at least one flow aperture 36 and through the valve opening 46 and, finally, out the exit 48 and into the user's mouth. As a quantity of substance is dispenses, the remaining non-dispensed product, internal apertures 36, passageways 32, 58, and storage chamber 22 remain in a sterile condition unexposed to the external atmosphere.

Figure 4:
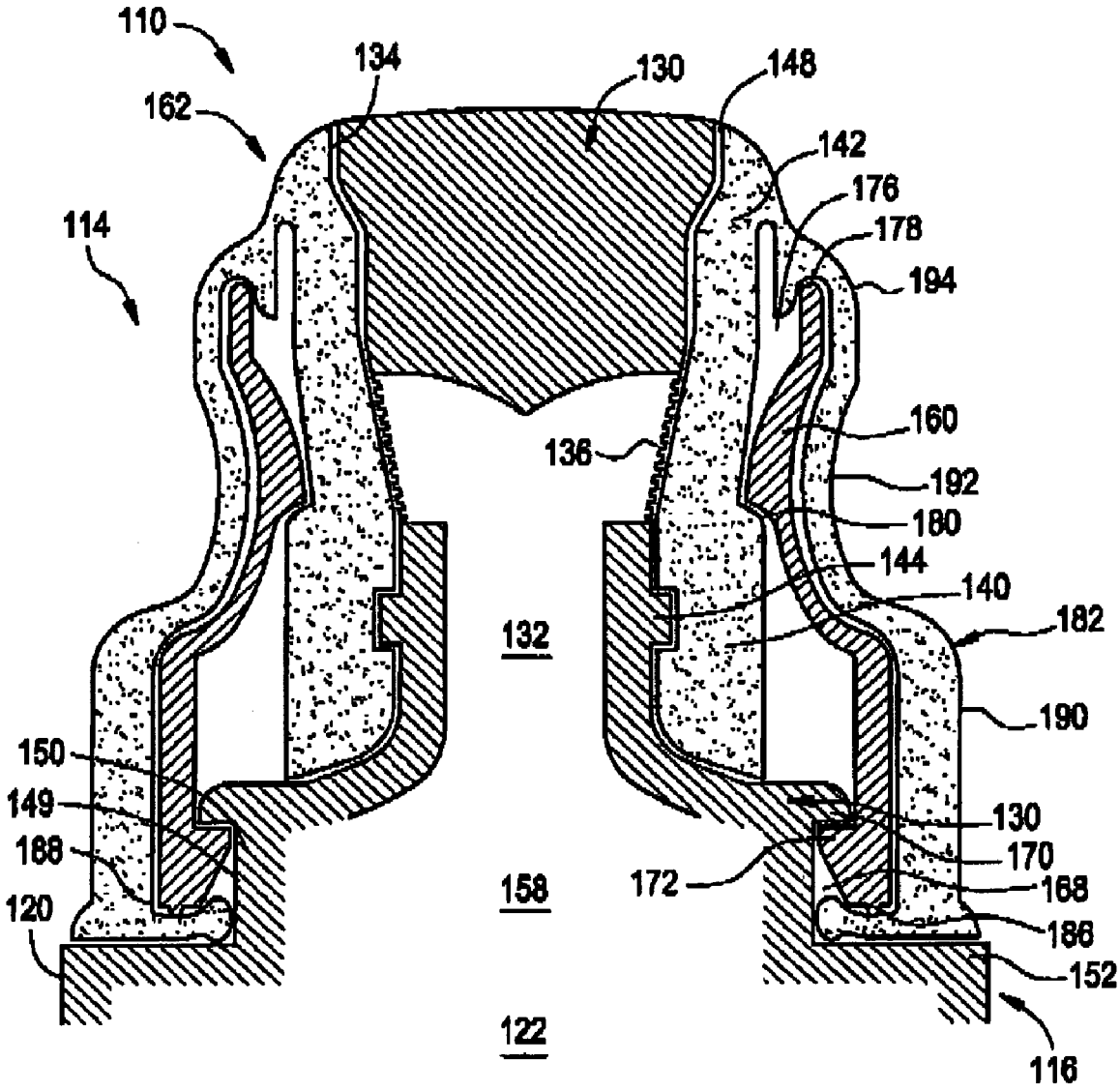
FIG. 4 is a cross-sectional view of another embodiment of the one-way valve of FIG. 1.
Figure 5:
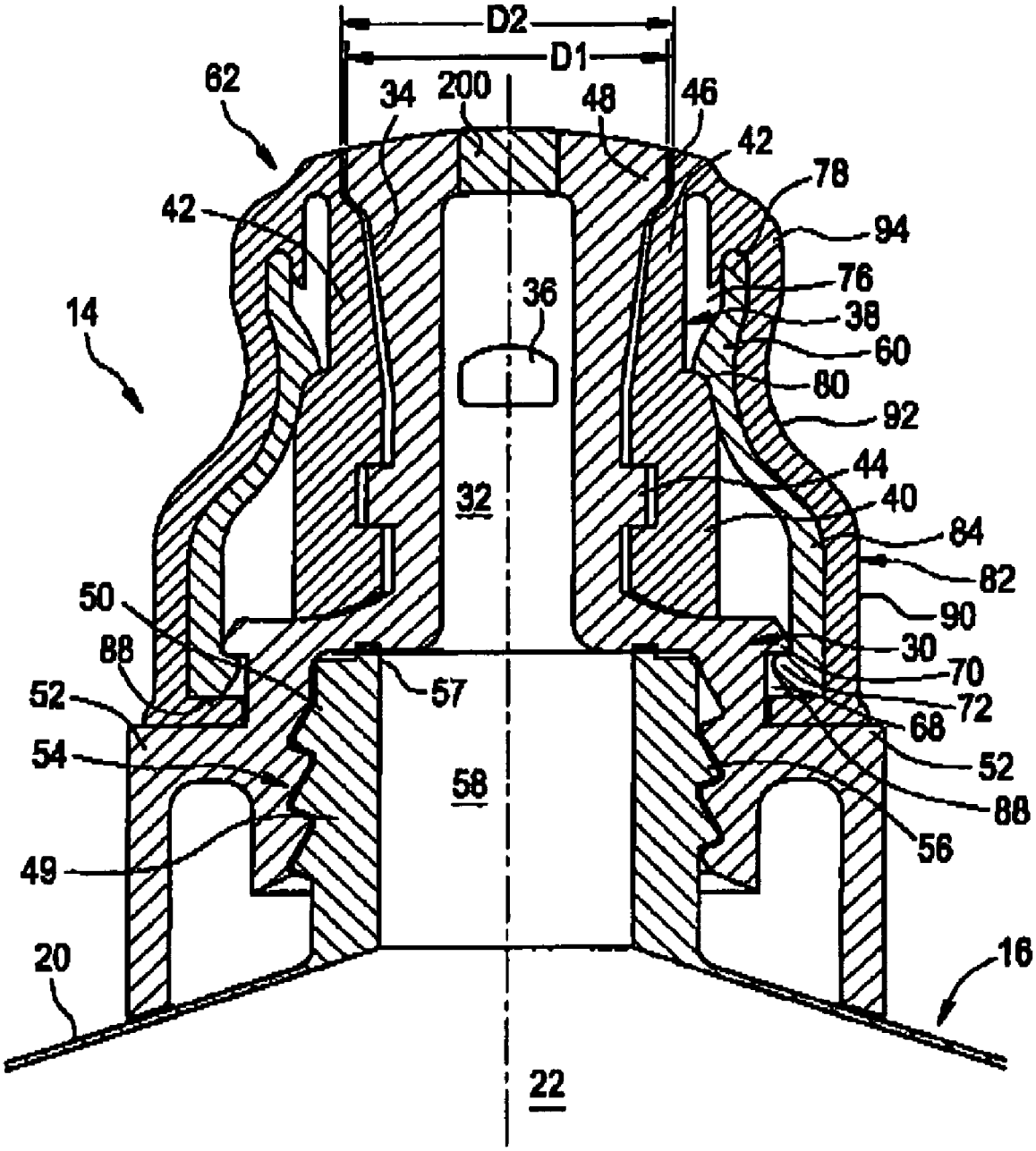
FIG. 5 is a cross-sectional view of another embodiment of the one-way valve of FIG. 1.

Drawing attention to FIG. 4, an alterative embodiment of the valve assembly 14 is shown. This embodiment is similar to the embodiment illustrated in FIG. 3 and, therefore, like reference numerals preceded by the numeral "1" are used to indicate like elements. In this embodiment, the body base 130 is formed integrally with the body 120. Flow apertures 136 are similar to the embodiment in FIG. 3; however, the cross-section is taken through a different section to illustrate the flow apertures in a different manner. In addition, the first axially-extending passageway 132 terminates at the diametrically oppose flow apertures 136. In this embodiment, the valve cover 138 extends over the valve shield 160 to form an outer cover 182 as described above. Furthermore, the container valve assembly 110 operates in a like manner, in which case squeezing the container allows passage of the substance from the storage chamber 122 through the valve opening and hermetically seals the valve 114 to prevent the ingress of air and bacteria through the valve 114 and into the container 116.

May aspects of the valve assembly and tubes disclosed herein may be the same as or similar to aspects of the valves and tubes disclosed in the following commonly assigned patent applications which are hereby expressly incorporated by reference in their entirety as part of the present disclosure: U.S. patent application Ser. No. 11/295, 274, filed Dec. 5, 2005, entitled "Container and Valve Assembly for Storing and Dispensing Substances, and Related Method", U.S. Patent Application Ser. No. 60/730,520, filed Oct. 26, 2005, entitled "Container and One-Way Valve Assembly for Storing and Dispensing Substances, and related Method", U.S. Patent Application Ser. No. 60/633,332, filed Dec. 5, 2005, entitled "One-Way Valve, Apparatus and Method of Using the Valve", U.S. patent application Ser. No. 10/640,500, filed Aug. 13, 2003, entitled "Container and Valve Assembly for Storing and Dispensing Substances, and Related Method", U.S. Patent Application Ser. No. 29/174,939, filed Jan. 27, 2003, entitled "Container and Valve Assembly", U.S. Patent Application Ser. No. 29/188,310, filed Aug. 15, 2003, entitled "Tube and Valve Assembly", U.S. Patent Application Ser. No. 29/191, 510, filed Oct. 7, 2003, entitled "Container and Valve Assembly", and U.S. Patent Application Ser. No. 60/528,429, filed Dec. 10, 2003, entitled "Valve Assembly and Tube Kit for Storing and Dispensing Substances, and Related Method," U.S. Patent Application Ser. No. 60/539,602, filed Jan. 27, 2004, entitled "Container and One-Way Valve Assembly for Storing and Dispensing Substances, and Related Method," each of which is assigned to the Assignee of the present invention and is hereby expressly incorporated by reference as part of the present disclosure.

Having thus described the inventive embodiments, it should be known that the containers 16 and 116 may be sterilized and filled in the manner such as that disclosed in U.S. patent application Ser. No. 10/600,525, filed on Jun. 19, 2003, entitled "Sterile Filling Machine having Needle Filling Station within E-Beam Chamber" and U.S. patent application Ser. No. 10/983,178, filed on Nov. 5, 2004, entitled "Needle Filling and Laser Sealing Station," and of which are hereby expressly incorporated by reference in their entirety as part of the present disclosure. Furthermore, the container and valve assembly 10 could include a pump (not shown) that is manually or otherwise actuated to dispense substance from the storage chamber 22 through the valve. This type of pump could include a piston received within a compression chamber wherein the piston is manually or otherwise actuated to dispense the substance through the valve, or a peristaltic pump that engages a flexible tube connected between the valve and storage chamber. Still even further, at least a portion of at least one of the pump, valve cover 38, valve body 30, valve seat 34, valve shield 60, a surface of the storage chamber 22 or any other portion of the container and valve assembly 10 the valve 14 could include a needle penetrable and thermally-resealable portion or stopper 200 (not shown) to enable filling the storage chamber 22 with the substance by: penetrating the thermally-resealable portion with a needle, introducing the substance through the needle and into the storage chamber 22, withdrawing the needle, and hermetically resealing the a resulting needle hole/aperture in the needle penetrable and thermally-resealable portion by applying thermal energy thereto,

While the invention has been described with reference to exemplary embodiments, it will be understood by those skilled in the art that various changes may be made and equivalents may be substituted for elements thereof without departing from the spirit and scope of the invention. In addition, many modifications may be made to adapt a particular situation or material to the teachings of the invention without departing from the essential scope thereof. Therefore, it is intended that the invention not be limited to the particular embodiments disclosed for carrying out this invention, but that the invention will include all embodiments falling within the scope of the appended claims.

What is claimed is:

1. A device for storing and dispensing a substance therefrom, comprising:

a device body defining therein a variable-volume storage chamber for receiving and storing a substance; and a one-way valve assembly mounted on the device body comprising:

(a) a valve body including:

a body base defining a passageway coupled in fluid communication with the variable-volume storage chamber a valve seat; and at least one flow aperture extending through the valve body; and (b) a valve cover formed of an elastic material, and including:

an outer valve cover shaped to receive thereon a user's mouth to consume the substance from the storage chamber out of the outer valve cover;

a valve shield mounted inwardly relative to the outer valve cover, wherein the valve shield supports the outer valve cover when a user applies pressure to the outer valve cover;

a valve portion overlying the valve seat, wherein the valve portion and valve seat define a normally closed, annular, axially extending valve opening therebetween, and the valve portion is movable radially between a normally closed position with the valve portion engaging the valve seat and an open position with a segment of the valve portion spaced radially away from the valve seat to allow the passage of substance from the variable-volume storage chamber therebetween; and wherein at least part of the valve shield is spaced radially away from the valve portion so as not to interfere with the valve opening.

2. A device as defined in claim 1, wherein at least one of the valve seat diameter, a degree of interference between the valve cover and valve seat, the predetermined radial thickness of the valve portion, and a predetermined modulus of elasticity of the valve cover material is selected to (1) define a predetermined valve opening pressure generated upon at least one of (i) squeezing the device body and (ii) pumping the substance from the device body that allows passage of the substance from the variable-volume storage chamber through the valve opening, and (2) hermetically seal the valve and prevent the ingress of bacteria through the valve and into the device in the normally closed position.

3. A device as defined in claim 1, wherein a substantially annular segment of the valve portion engages the valve seat substantially throughout any period of dispensing substance through the valve opening to maintain a hermetic seal between the variable-volume storage chamber and ambient atmosphere.

4. A device as defined in claim 1, wherein at least one of (i) the valve cover and valve body define an increasing degree of interference therebetween in a direction from the interior to the exterior of the valve assembly, and (ii) the valve portion defines a decreasing radial thickness when moving axially in a direction from an inner end toward a distal end of the valve seat.

5. A device as defined in claim 1, wherein the device body is one of: (i) a squeezable body, and (ii) a relatively rigid body having a flexible bladder located therein, the flexible bladder defining the variable-volume storage chamber.

6. A device as defined in claim 1, wherein the device body comprises a head located at one end of body, and the head defines a neck portion and a first axially extending passageway formed therethrough that is coupled in fluid communication with the variable-volume storage chamber and defines an unobstructed axially extending flow path therebetween.

7. A device as defined in claim 1, further defining an unobstructed, substantially axially extending flow path between the variable-volume storage chamber and at least one flow aperture.

8. A device as defined in claim 1, wherein the variable volume storage chamber is configured to maintain the substance in at least one of (i) a sterile, hermetically sealed condition, (ii) a substantially airless condition, and (iii) a substantially preservative-free form, throughout the storing and dispensing of the substance.

9. A device as defined in claim 6, wherein the device body is formed integral with the head and the head forms the valve body.

10. A device as defined in claim 1, wherein at least a portion of at least one of the variable-volume storage chamber and one-way valve assembly is penetrable by a needle for filling the variable-volume storage chamber through the needle with the substance to be stored therein, and a resulting penetration aperture is thermally resealable by applying thermal energy thereto.

11. A device for storing and dispensing a substance therefrom, comprising:

a device body defining therein a variable-volume storage chamber for receiving and storing a substance; and a one-way valve assembly mounted on the device body comprising:

(a) a valve body including:

a body base defining a passageway coupled in fluid communication with the variable-volume storage chamber;

a valve seat; and at least one flow aperture extending through the valve body; and (b) a valve cover formed of an elastic material, and including:

an outer valve cover shaped to receive thereon a user's mouth to consume the substance from the storage chamber out of the outer valve cover;

a valve shield mounted inwardly relative to the outer valve cover, wherein the valve shield supports the outer valve cover when a user applies pressure to the outer valve cover;

a valve portion overlying the valve seat, wherein the valve portion and valve seat define a normally closed, annular, axially extending valve opening therebetween, and the valve portion is movable radially between a normally closed position with the valve portion engaging the valve seat and an open position with a segment of the valve portion spaced radially away from the valve seat to allow the passage of substance from the variable-volume storage chamber therebetween;

wherein at least part of the valve shield is spaced radially away from the valve portion so as not to interfere with the valve opening; and wherein the valve assembly further includes first means for progressively opening the valve opening and allowing the passage of substance from the variable-volume storage chamber through the valve opening upon at least one of (i) squeezing the device body and (ii) pumping substance from the device body, and second means for hermetically sealing the valve assembly and preventing ingress of bacteria through the valve assembly and into the device in the normally closed position.

12. A device as defined in claim 11, wherein the first means is defined by at least one of the valve seat diameter, a degree of interference between the valve cover and valve seat, the predetermined radial thickness of the valve portion, and a predetermined modulus of elasticity of the valve cover material being selected to define a predetermined valve opening pressure generated upon at least one of (i) squeezing the device body and (ii) pumping the substance from the device body that allows passage of the substance from the variable-volume storage chamber through the valve opening.

13. A device as defined in claim 11, wherein the second means is defined by at least one of the valve seat diameter, a degree of interference between the valve cover and valve seat, the predetermined radial thickness of the valve portion, and a predetermined modulus of elasticity of the valve cover material being selected to hermetically seal the valve and prevent the ingress of bacteria through the valve and into the device in the normally closed position.

14. A method for storing and dispensing a sterile substance comprising the steps of:

providing a device including a device body defining therein a variable-volume storage chamber for receiving and storing a substance;

providing a one-way valve assembly mounted on the device body comprising:

(a) a valve body including:

a body base defining a passageway coupled in fluid communication with the variable-volume storage chamber a valve seat; and at least one flow aperture extending through the valve body; and (b) a valve cover formed of an elastic material, and including:

an outer valve cover shaped to receive thereon a user's mouth to consume the substance from the storage chamber out of the outer valve cover;

a valve shield mounted inwardly relative to the outer valve cover, wherein the valve shield supports the outer valve cover when a user applies pressure to the outer valve cover; and a valve portion overlying the valve seat, wherein the valve portion and valve seat define a normally closed, annular, axially extending valve opening therebetween, and the valve portion is movable radially between a normally closed position with the valve portion engaging the valve seat and an open position with a segment of the valve portion spaced radially away from the valve seat to allow the passage of substance from the variable-volume storage chamber therebetween;

wherein at least part of the valve shield is spaced away from the valve portion so as not to interfere with the valve opening and allow the valve portion to move between the valve seat and shield;

storing within the storage chamber a quantity of substance; and dispensing an amount of the substance by at least one of squeezing the device body and pumping the substance from the storage chamber to dispense the substance through the valve opening and into the user's mouth.

15. A method as defined in claim 14, further comprising the step of maintaining the substance in at least one of: (i) a sterile, hermetically sealed condition, (ii) a substantially airless condition, and (iii) a substantially preservative-free form, throughout the storing and dispensing of the substance.

16. A method as defined in claim 14, further comprising the step of maintaining the substance at ambient temperature throughout the storing and dispensing of multiple doses of the substance.

17. A method as defined in claim 14, further comprising the steps of:

providing at least one of the variable-volume storage chamber and one-way valve assembly with a needle penetrable portion and thermally resealable portion; and filling the variable-volume storage chamber with the substance by penetrating the needle penetrable and thermally resealable portion with a needle, introducing the substance through the needle and into the variable-volume storage chamber, withdrawing the needle and hermetically resealing a resulting needle hole in the needle penetrable and thermally resealable portion by applying thermal energy thereto.

18. A container and valve assembly as defined in claim 6, wherein the passageway defined by the body base is a second axially extending passageway coupled in fluid communication with the first axially extending passageway and defining an unobstructed axially extending flow path therebetween, and the valve seat is axially-extending.

19. A container and valve assembly as defined in claim 1, wherein the valve portion defines a predetermined radial thickness and a diameter less than a diameter of the valve seat to thereby form an interference fit therebetween.

20. A container and valve assembly as defined in claim 1, wherein the valve seat is movable radially between the normally closed position and the open position at a predetermined valve opening pressure.

* * * * *

UNITED STATES PATENT AND TRADEMARK OFFICE

CERTIFICATE OF CORRECTION

PATENT NO. : 7,637,400 B2
APPLICATION NO. : 11/301659
DATED : December 29, 2009
INVENTOR(S) : Daniel Py and Julian V. Chan It is certified that error appears in the above-identified patent and that said Letters Patent is hereby corrected as shown below:

Column 8, line 46 should read --chamber;-- the phrase "a valve seat; and" should appear on its own line

Signed and Sealed this

Second Day of November, 2010

David J. Kappos

David J. Kappos
*Director of the United States Patent and Trademark Office*